US011293127B2

(12) United States Patent
Kwon et al.

(10) Patent No.: US 11,293,127 B2
(45) Date of Patent: Apr. 5, 2022

(54) WASHING MACHINE AND CONTROL METHOD THEREOF

(71) Applicant: LG Electronics Inc., Seoul (KR)

(72) Inventors: Oshin Kwon, Seoul (KR); Byunghyun Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 151 days.

(21) Appl. No.: 16/493,240

(22) PCT Filed: Mar. 9, 2018

(86) PCT No.: PCT/KR2018/002818
§ 371 (c)(1),
(2) Date: Sep. 11, 2019

(87) PCT Pub. No.: WO2018/164529
PCT Pub. Date: Sep. 13, 2018

(65) Prior Publication Data

US 2020/0131682 A1 Apr. 30, 2020

(30) Foreign Application Priority Data

Mar. 9, 2017 (KR) ..... 10-2017-0030245

(51) Int. Cl.
*D06F 33/48* (2020.01)
*D06F 37/22* (2006.01)
(Continued)

(52) U.S. Cl.
CPC ..... *D06F 33/48* (2020.02); *D06F 34/16* (2020.02); *D06F 37/22* (2013.01); *D06F 37/225* (2013.01);
(Continued)

(58) Field of Classification Search
CPC ..... D06F 33/48
See application file for complete search history.

(56) References Cited

U.S. PATENT DOCUMENTS

2007/0283726 A1* 12/2007 Lee ..... D06F 35/007 68/12.06
2012/0192362 A1 8/2012 Matsumoto et al.

FOREIGN PATENT DOCUMENTS

EP 2520700 11/2012
EP 3045580 7/2016
(Continued)

OTHER PUBLICATIONS

EP Extended Search Report in European Appln. No. 18764728.4, dated Nov. 4, 2020, 11 pages.
(Continued)

*Primary Examiner* — Jason Y Ko
(74) *Attorney, Agent, or Firm* — Fish & Richardson P.C.

(57) ABSTRACT

The washing machine includes a tub, a drum, a plurality of balancing units moving along the circumference of a front side or a rear side of the drum in order to reduce imbalance caused by concentration of laundry when the drum rotates, a vibration sensor sensing a vibration amount of the tub, and a controller moving the plurality of balancing units according to the vibration amount of the tub, measured by the vibration sensor. The controller controls a drum motor to rotate the drum at a constant rotation speed, moves the plurality of balancing units in the same rotation direction to minimize the vibration amount of the tub, measured by the vibration sensor, and thereafter moves the plurality of balancing units in different rotation directions to minimize the vibration amount of the tub, measured by the vibration sensor, thereby reducing imbalance.

9 Claims, 7 Drawing Sheets

(51) Int. Cl.

| | |
|---|---|
| ***D06F 34/16*** | (2020.01) |
| *D06F 103/24* | (2020.01) |
| *D06F 103/26* | (2020.01) |
| *D06F 105/00* | (2020.01) |
| *D06F 105/48* | (2020.01) |

(52) U.S. Cl.
CPC ..... *D06F 2103/24* (2020.02); *D06F 2103/26* (2020.02); *D06F 2105/00* (2020.02); *D06F 2105/48* (2020.02)

(56) References Cited

FOREIGN PATENT DOCUMENTS

| | | |
|---|---|---|
| JP | H03111096 | 5/1991 |
| JP | 2005021505 | 1/2005 |
| KR | 1020110010945 | 2/2011 |
| KR | 1020120124769 | 11/2012 |
| KR | 1020150010185 | 1/2015 |
| KR | 1020150030832 | 3/2015 |
| KR | 101680662 | 11/2016 |

OTHER PUBLICATIONS

PCT International Search Report in International Appln. No. PCT/KR2018/002818, dated Jul. 13, 2018, 7 pages (with English translation).

* cited by examiner

WASHING MACHINE AND CONTROL METHOD THEREOF

CROSS-REFERENCE TO RELATED APPLICATIONS

This application is a National Stage application under 35 U.S.C. § 371 of International Application No. PCT/KR2018/002818, filed on Mar. 9, 2018, which claims the benefit of Korean Application No. 10-2017-0030245, filed on Mar. 9, 2017. The disclosures of the prior applications are incorporated by reference in their entirety.

TECHNICAL FIELD

The present invention relates to a washing machine and a control method thereof, and more particularly to a washing machine, which is provided with a balancer that is actively movable, and a control method thereof.

BACKGROUND ART

Generally, a washing machine is an apparatus for cleaning laundry through washing, rinsing, and dehydration in order to remove dirt from clothes, bedding and the like (hereinafter referred to as 'laundry') using water, detergent, and mechanical operation.

A washing machine is provided with a balancer to reduce imbalance that occurs when laundry in a drum is unevenly distributed. A ball balancer or a liquid balancer is used as the balancer in the washing machine. However, since the ball balancer or the liquid balancer moves passively according to the rotation of a drum, there is a problem in that the drum needs to be continuously rotated until the ball balancer or the liquid balancer moves to the side opposite the center of mass of laundry to thus reduce the imbalance. In order to solve this problem, a structure of actively moving a balancer has been proposed, and a method of controlling an actively movable balancer to reduce imbalance has been required.

DISCLOSURE

Technical Problem

Therefore, the present invention has been made in view of the above problems, and it is an object of the present invention to provide a washing machine, in which a balancing method is performed to control an actively movable balancer in order to reduce imbalance, and a control method thereof.

However, the objects to be accomplished by the invention are not limited to the above-mentioned objects, and other objects not mentioned herein will be clearly understood by those skilled in the art from the following description.

Technical Solution

In accordance with the present invention, the above and other objects can be accomplished by the provision of a washing machine including a tub, a drum, a plurality of balancing units moving along the circumference of a front side or a rear side of the drum in order to reduce imbalance caused by concentration of laundry when the drum rotates, a vibration sensor sensing a vibration amount of the tub, and a controller moving the plurality of balancing units according to the vibration amount of the tub, measured by the vibration sensor. The controller controls a drum motor to rotate the drum at a constant rotation speed, moves the plurality of balancing units in the same rotation direction to minimize the vibration amount of the tub, measured by the vibration sensor, and thereafter moves the plurality of balancing units in different rotation directions to minimize the vibration amount of the tub, measured by the vibration sensor, thereby reducing imbalance.

The controller may perform direct balancing of repeating an operation of moving the plurality of balancing units in the same rotation direction and then in different rotation directions until the vibration amount of the tub, measured by the vibration sensor, becomes equal to or smaller than a predetermined balancing vibration amount.

The plurality of balancing units may include a plurality of front balancing units moving along the circumference of the front side of the drum and a plurality of rear balancing units moving along the circumference of the rear side of the drum, and the vibration sensor may include a front vibration sensor sensing a front vibration amount of the tub and a rear vibration sensor sensing a rear vibration amount of the tub. The controller may perform the direct balancing for the plurality of rear balancing units until the rear vibration amount of the tub, measured by the rear vibration sensor, becomes equal to or smaller than a predetermined rear balancing vibration amount, and thereafter may perform the direct balancing for the plurality of front balancing units until the front vibration amount of the tub, measured by the front vibration sensor, becomes equal to or smaller than a predetermined front balancing vibration amount. In this case, the rear balancing vibration amount may be equal to or greater than the front balancing vibration amount.

When the drum rotates at a first rough rotation speed, which is the rotation speed at which the laundry starts to cling to the inner circumferential surface of the drum, the controller may perform first rough balancing of performing the direct balancing for the plurality of balancing units so that the vibration amount of the tub, measured by the vibration sensor, does not exceed a predetermined first rough balancing vibration amount. In addition, when the drum rotates at a second rough rotation speed, which is higher than the first rough rotation speed, the controller may perform second rough balancing of performing the direct balancing for the plurality of balancing units so that the vibration amount of the tub, measured by the vibration sensor, does not exceed a predetermined second rough balancing vibration amount. In this case, the second rough balancing vibration amount may be greater than the first rough balancing vibration amount.

When the drum rotates at a third rough rotation speed, which is higher than the second rough rotation speed, the controller may perform third rough balancing of performing the direct balancing for the plurality of balancing units so that the vibration amount of the tub, measured by the vibration sensor, does not exceed a predetermined third rough balancing vibration amount. In this case, the third rough balancing vibration amount may be smaller than the first rough balancing vibration amount.

When the controller controls the drum motor to accelerate the drum, if the vibration amount of the tub, measured by the vibration sensor, exceeds a predetermined excessive vibration amount, the controller may control the drum motor to maintain the rotation speed of the drum, and may perform excessive balancing of performing the direct balancing for the plurality of balancing units until the vibration amount of the tub, measured by the vibration sensor, becomes equal to or smaller than a predetermined excessive balancing vibration amount. In this case, the excessive balancing vibration amount may be equal to or greater than the second rough balancing vibration amount, and the excessive vibration amount may be greater than the excessive balancing vibration amount.

When the drum rotates at a fine rotation speed, which is the maximum rotation speed at which the plurality of balancing units is movable, the controller may perform the direct balancing for the plurality of balancing units so that the vibration amount of the tub, measured by the vibration sensor, does not exceed a predetermined fine balancing vibration amount, and thereafter may perform correction balancing of changing an included angle of the plurality of balancing units by a predetermined variation value.

In accordance with the present invention, the above and other objects can be accomplished by the provision of a control method of a washing machine, including a first rough balancing step of performing direct balancing for a plurality of balancing units so that a vibration amount of a tub, measured by a vibration sensor, does not exceed a predetermined first rough balancing vibration amount when a drum rotates at a first rough rotation speed, which is the rotation speed at which laundry starts to cling to the inner circumferential surface of the drum, and a second rough balancing step of performing the direct balancing for the plurality of balancing units so that the vibration amount of the tub, measured by the vibration sensor, does not exceed a predetermined second rough balancing vibration amount when the drum rotates at a second rough rotation speed, which is higher than the first rough rotation speed. The direct balancing may be performed by repeating an operation of moving the plurality of balancing units in the same rotation direction to minimize the vibration amount of the tub, measured by the vibration sensor, and an operation of moving the plurality of balancing units in different rotation directions to minimize the vibration amount of the tub, measured by the vibration sensor, thereby reducing imbalance.

The method may further include, when the drum rotates at a third rough rotation speed, which is higher than the second rough rotation speed, a third rough balancing step of performing the direct balancing for the plurality of balancing units so that the vibration amount of the tub, measured by the vibration sensor, does not exceed a predetermined third rough balancing vibration amount.

The method may further include, when the drum is accelerated from the second rough rotation speed to the third rough rotation speed, if the vibration amount of the tub, measured by the vibration sensor, exceeds a predetermined excessive vibration amount, an excessive balancing step of performing the direct balancing for the plurality of balancing units until the vibration amount of the tub, measured by the vibration sensor, becomes equal to or smaller than a predetermined excessive balancing vibration amount while controlling a drum motor to maintain the rotation speed of the drum.

The method may further include, when the drum rotates at a fine rotation speed, which is higher than the third rough rotation speed, a fine balancing step of performing the direct balancing for the plurality of balancing units so that the vibration amount of the tub, measured by the vibration sensor, does not exceed a predetermined fine balancing vibration amount, and thereafter performing correction balancing of changing an included angle of the plurality of balancing units by a predetermined variation value. In this case, the fine rotation speed may be the maximum rotation speed at which the plurality of balancing units is movable.

Details of other embodiments are included in the detailed description and the accompanying drawings.

Advantageous Effects

According to a washing machine and a control method thereof of the present invention, there are one or more effects as follows.

First, balancing units, which are balancers that are actively movable, are controlled according to the amount of vibration of a tub, which is measured in real time, thereby reducing imbalance quickly and accurately.

Second, the amount of vibration of the tub may quickly reach a set value with a simple control by repeating an operation of moving a plurality of balancing units in the same rotation direction and then in different rotation directions.

Third, it is possible to perform balancing for a plurality of rear balancing units, which move along the circumference of the rear side of a drum, and then to perform balancing for a plurality of front balancing units, which move along the circumference of the front side of the drum, thereby preferentially reducing imbalance at the rear side of the drum, at which a relatively large amount of vibration is generated.

Fourth, it is possible to respond to a change of imbalance and to accurately reduce imbalance by repeating balancing for the plurality of rear balancing units and balancing for the plurality of front balancing units.

Fifth, excessive balancing may be performed or may not be performed according to the amount of vibration of the tub, which is measured in real time while accelerating the drum in a section in which resonance occurs, making it possible to quickly pass through the resonance section.

Sixth, when the drum rotates at a high speed, a change of imbalance due to a reduction in the water content of laundry may be estimated in advance, and balancing is performed at the maximum speed at which the plurality of balancing units is movable, thereby preventing the occurrence of vibration and noise attributable to imbalance in a section in which it is impossible to control the plurality of balancing units.

Seventh, based on the vibration amount of the tub, which is measured while accelerating the drum to a high speed during first dehydration, and the amount of laundry, which is measured by stopping the rotation of the drum after the first dehydration, it is possible to perform balancing for the plurality of balancing units before second dehydration, at which the drum rotates at a high speed.

However, the effects achievable through the invention are not limited to the above-mentioned effects, and other effects not mentioned herein will be clearly understood by those skilled in the art from the appended claims.

BEST MODE

Figure 1:
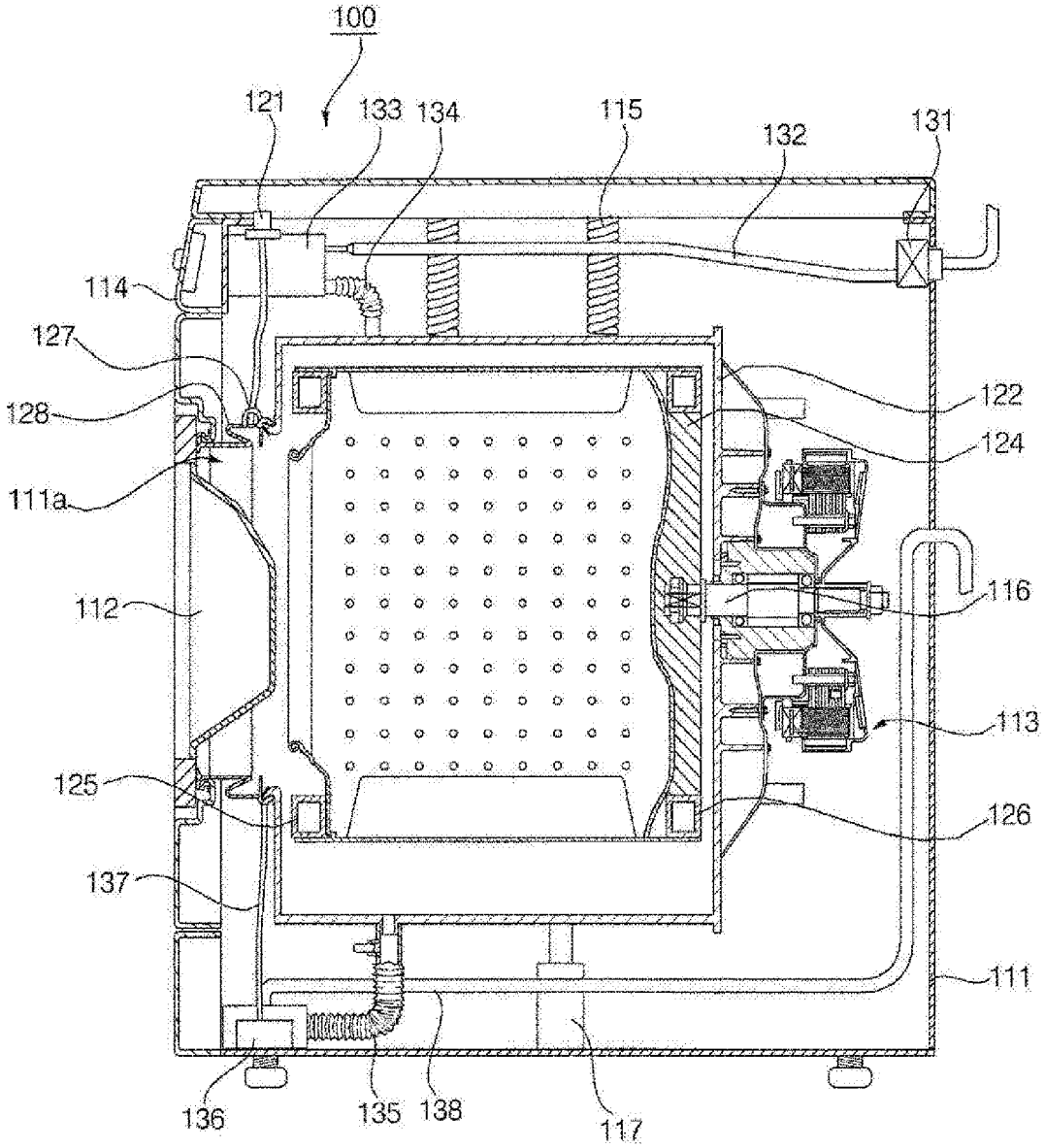
FIG. 1 is a cross-sectional view of a washing machine according to an embodiment of the present invention.

Advantages and features of the present invention and methods for achieving them will be made clear from the embodiments described below in detail with reference to the accompanying drawings. The present invention may, however, be embodied in many different forms, and should not be construed as being limited to the embodiments set forth herein. Rather, these embodiments are provided so that this disclosure will be thorough and complete, and will fully convey the scope of the invention to those skilled in the art. The present invention is merely defined by the scope of the claims. Like reference numerals refer to like elements throughout the specification.

Hereinafter, embodiments of the present invention will be described with reference to the accompanying drawings for explaining a washing machine and a control method thereof.

Figure 2:
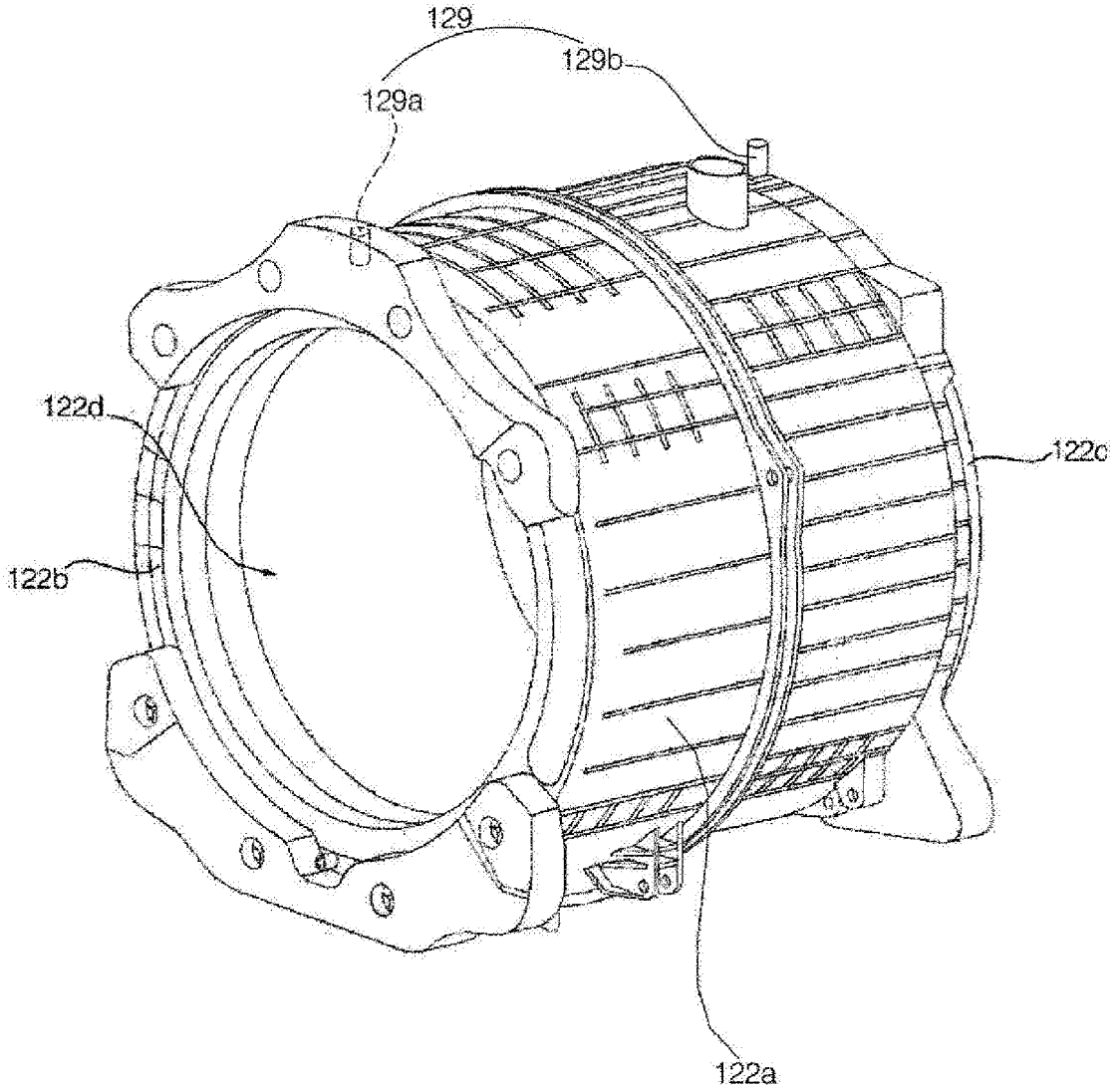
FIG. 2 is a perspective view of a drum of the washing machine shown in FIG. 1.
Figure 3:
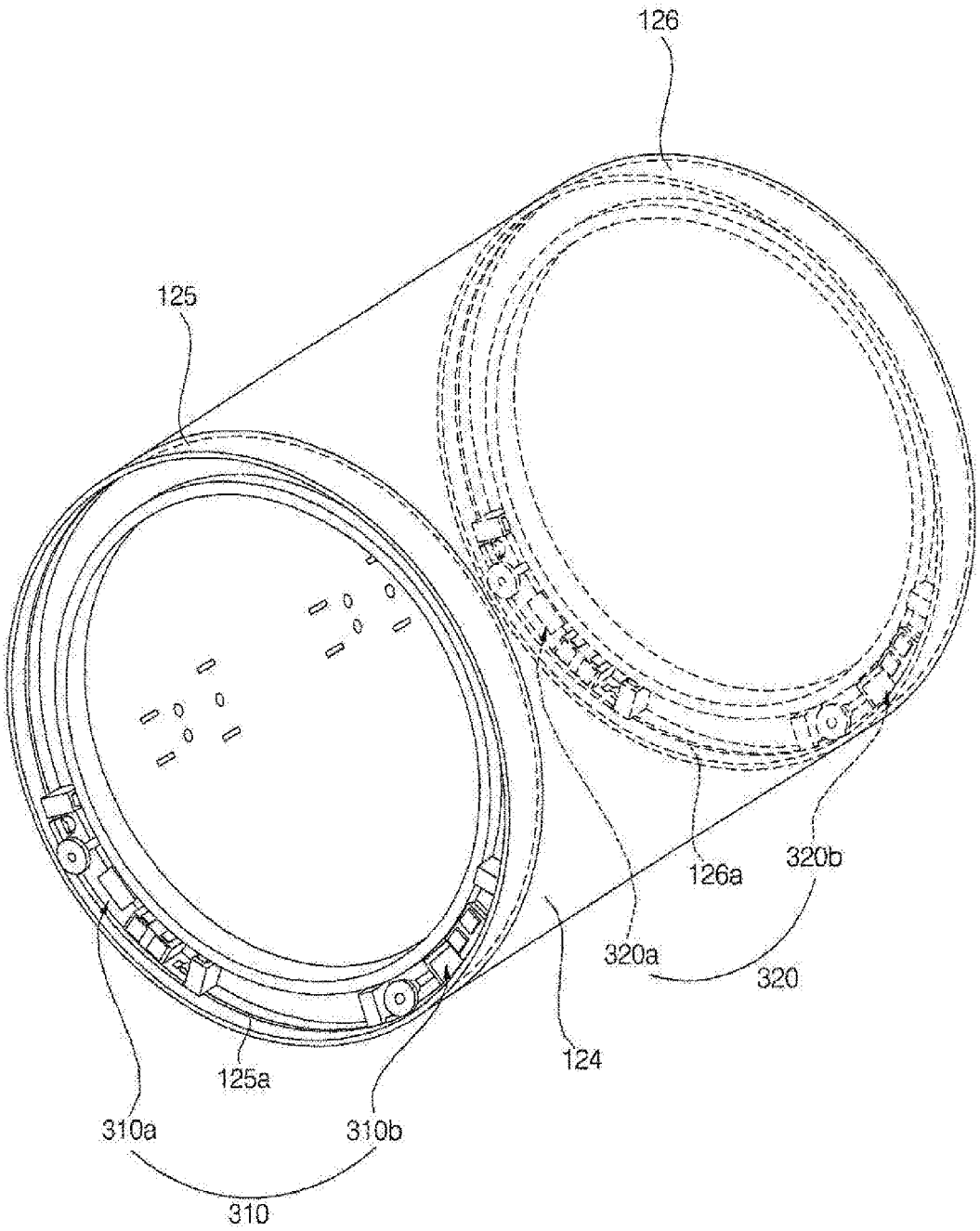
FIG. 3 is a perspective view of a tub of the washing machine shown in FIG. 1.

FIG. 1 is a cross-sectional view of a washing machine according to an embodiment of the present invention, FIG. 2 is a perspective view of a drum of the washing machine shown in FIG. 1, and FIG. 3 is a perspective view of a tub of the washing machine shown in FIG. 1.

A washing machine 100 according to an embodiment of the present invention includes a cabinet 111, which forms the external appearance of the washing machine, a door 112, which opens and closes one side of the cabinet so that laundry may be put into the cabinet, a tub 122, which is disposed in the cabinet and is supported by the cabinet, a drum 124, which is disposed in the tub and rotates with laundry loaded therein, a drum motor 113, which applies torque to the drum to rotate the same, a detergent box 133, in which detergent is contained, and a control panel 114, which receives user input and displays the state of the washing machine.

The cabinet 111 has a laundry entrance hole 111*a* formed therein to put laundry into the cabinet. The door 112 is rotatably coupled to the cabinet 111 so as to open and close the laundry entrance hole 111*a*. The cabinet 111 is provided with the control panel 114. The detergent box 133 is provided in the cabinet 111 so as to be drawn out therefrom.

The tub 122 is disposed inside the cabinet 111 so as to be elastically supported by a spring 115 and a damper 117. The tub 122 contains wash water. The tub 122 is disposed outside the drum 124 while surrounding the drum 124.

The tub 122 includes a tub main body 122*a*, which has a cylindrical shape having open opposite ends, a front tub cover 122*b*, which has a ring shape and is disposed at a front side of the tub main body 122*a*, and a rear tub cover 122*c*, which has a disc shape and is disposed at a rear side of the tub main body 122*a*. Hereinafter, "front side" refers to the side on which the door 112 is disposed, and "rear side" refers to the side on which the drum motor 113 is disposed.

The front tub cover 122*b* has a tub hole 122*d* formed therein. The tub hole 122*d* is formed so as to communicate with the laundry entrance hole 111*a* to allow laundry to be put into the drum 124.

The drum motor 113 is provided at the rear tub cover 122*c* and generates torque. The drum motor 113 is connected with a rotary shaft 116 to rotate the drum 124. The drum motor 113 may rotate the drum 124 at various speeds or in various directions. The drum motor 113 includes a stator (not shown) on which a coil is wound, and a rotor (not shown), which rotates by generating electromagnetic interaction with the coil.

The rotary shaft 116 connects the drum motor 113 to the drum 124. The rotary shaft 116 transmits the torque of the drum motor 113 to the drum 124 in order to rotate the drum 124. One end of the rotary shaft 116 is connected to the center of rotation at the rear side of the drum 124, and the opposite end of the rotary shaft 116 is coupled to the rotor (not shown) of the drum motor 113.

The drum 124 rotates with laundry loaded therein. The drum 124 is disposed inside the tub 122. The drum 124 is formed in a cylindrical shape that is rotatable. The drum 124 has a plurality of through-holes formed therein to allow wash water to pass therethrough. The drum 124 rotates by receiving the torque of the drum motor 113.

The drum 124 has a drum hole 124*a* formed in the front side thereof. The drum hole 124*a* is formed so as to communicate with the laundry entrance hole 111*a* and the tub hole 122*d* so that laundry is put into the drum 124. A front guide rail 125 is coupled to the front circumference of the drum 124, and a rear guide rail 126 is coupled to the rear circumference of the drum 124.

A gasket 128 is provided to realize a seal between the tub 122 and the cabinet 111. The gasket 128 is disposed between the inlet of the tub 122 and the laundry entrance hole 111*a*. The gasket 128 absorbs shocks transmitted to the door 112 when the drum 124 rotates, and prevents wash water in the tub 122 from leaking outside. The gasket 128 may be provided with a circulation nozzle 127, which sprays wash water into the drum 124.

The detergent box 133 contains detergent, fabric softener, bleach, or the like. It is desirable for the detergent box 133 to be provided at the front surface of the cabinet 111 so as to be drawn out therefrom. When wash water is supplied, the detergent in the detergent box 133 is mixed with the wash water to be introduced into the tub 122.

Preferably, the cabinet 111 is provided therein with a water supply valve 131, which adjusts the introduction of wash water from an external water source, a water supply passage 132 through which the wash water introduced into the water supply valve flows to the detergent box 133, and a water supply pipe 134 through which the wash water mixed with the detergent in the detergent box 133 is introduced into the tub 122.

Preferably, the cabinet 111 is provided therein with a drain pipe 135 through which the wash water in the tub 122 is discharged, a pump 136, which discharges the wash water in the tub, a circulation passage 137, through which the wash water circulates, a circulation nozzle 127, which introduces the wash water into the drum 124, and a drain passage 138, through which the wash water is discharged outside. In some embodiments, the pump 136 may include a circulation pump and a drain pump, which may be respectively connected to the circulation passage 137 and the drain passage 138.

The drain pipe 135 may be provided with a water level sensor 121, which senses the level of the wash water contained in the tub 122. The water level sensor 121 may be implemented in any of various types. In the embodiment, the level of water is measured by changing the distance between electrodes using variation in air pressure depending on a change in the level of wash water and by measuring variation in the capacitance of the electrodes.

A plurality of front balancing units 310 moves along the front guide rail 125 of the drum 124, and a plurality of rear balancing units 320 moves along the rear guide rail 126, thereby changing the center of gravity of the drum 124. In this case, the center of gravity of the drum 124 does not refer to the center of mass of the drum 124 itself, but refers to a common center of gravity of objects, including the drum 124, the laundry put in the drum 124, the front guide rail 125, the rear guide rail 126, the plurality of front balancing units 310, the plurality of rear balancing units 320, and other components attached to the drum 124, which rotate together with the drum 124 when the drum 124 rotates.

The plurality of front balancing units 310 moves along the circumference of the front side of the drum 124, and the plurality of rear balancing units 310 moves along the circumference of the rear side of the drum 124, thereby adjusting the center of gravity of the drum 124 when laundry is concentrated on one side. When the drum 124 rotates with the laundry concentrated on one side, vibration and noise may be generated by imbalance in which the geometrical center of the rotary shaft 116 (the center of rotation) of the drum 124 does not coincide with the actual center of gravity of the drum 124. The plurality of front balancing units 310 and the plurality of rear balancing units 320 bring the center of gravity of the drum 124 closer to the rotary shaft 116, thereby reducing imbalance of the drum 124. In the embodiment, the plurality of front balancing units 310 includes two units of a first front balancing unit 310*a* and a second front balancing unit 310*b*, and the plurality of rear balancing units 320 includes two units of a first rear balancing unit 320*a* and a second rear balancing unit 320*b*.

The plurality of front balancing units 310 moves actively along the front guide rail 125, and the plurality of rear balancing units 320 moves actively along the rear guide rail 126. "Active movement" refers to movement of the plurality of front balancing units 310 or the plurality of rear balancing units 320 along the front guide rail 125 or the rear guide rail 126 under their own power.

The front guide rail 125 is a passage along which the plurality of front balancing units 310 moves, and the rear guide rail 126 is a passage along which the plurality of rear balancing units 320 moves. The front guide rail 125 is formed in a ring shape and is coupled to the front end circumference of the drum 124, and the rear guide rail 126 is formed in a ring shape and is coupled to the rear end circumference of the drum 124. Each of the front guide rail 125 and the rear guide rail 126 may have protrusions so that the plurality of front balancing units 310 and the plurality of rear balancing units 320 are not separated therefrom. The front guide rail 125 is provided with a front guide rail wire 125*a* to transmit power to the plurality of front balancing units 310, and the rear guide rail 126 is provided with a rear guide rail wire 126*a* to transmit power to the plurality of rear balancing units 320. The front guide rail wire 125*a* and the rear guide rail wire 126*a* are connected to power supplied from an external source.

The tub 122 is provided with a plurality of vibration sensors 129 to sense the amount of vibration of the tub 122. The vibration caused by the imbalance of the drum 124 is transmitted to the tub 122 via the rotary shaft 116, causing vibration of the tub 122. The plurality of vibration sensors 129 senses the amount of vibration of the tub 122 to measure the degree of imbalance of the drum 124.

The plurality of vibration sensors 129 may be implemented as any one of various sensors that sense the amount of vibration of the tub 122. In the embodiment, it is desirable that the plurality of vibration sensors 129 be optical sensors that are provided in the tub main body 122*a* and measure the distance to the cabinet 111. In the embodiment, the plurality of vibration sensors 129 senses the amount of vibration using a change in the distance between the cabinet 111 and the tub 122. In the embodiment, the plurality of vibration sensors 129 includes a front vibration sensor 129*a*, which is provided at the front side of the tub main body 122*a* and senses a front vibration amount corresponding to the amount of vibration at the front side of the tub 122, and a rear vibration sensor 129*b*, which is provided at the rear side of the tub main body 122*a* and senses a rear vibration amount corresponding to the amount of vibration at the rear side of the tub 122.

The control panel 114 may be provided with an input unit (not shown), which receives input of a wash course selected by a user or input of various operation commands such as operation time and reservation of each cycle, and a display unit (not shown), which displays the state of operation of the washing machine 100.

Figure 4:
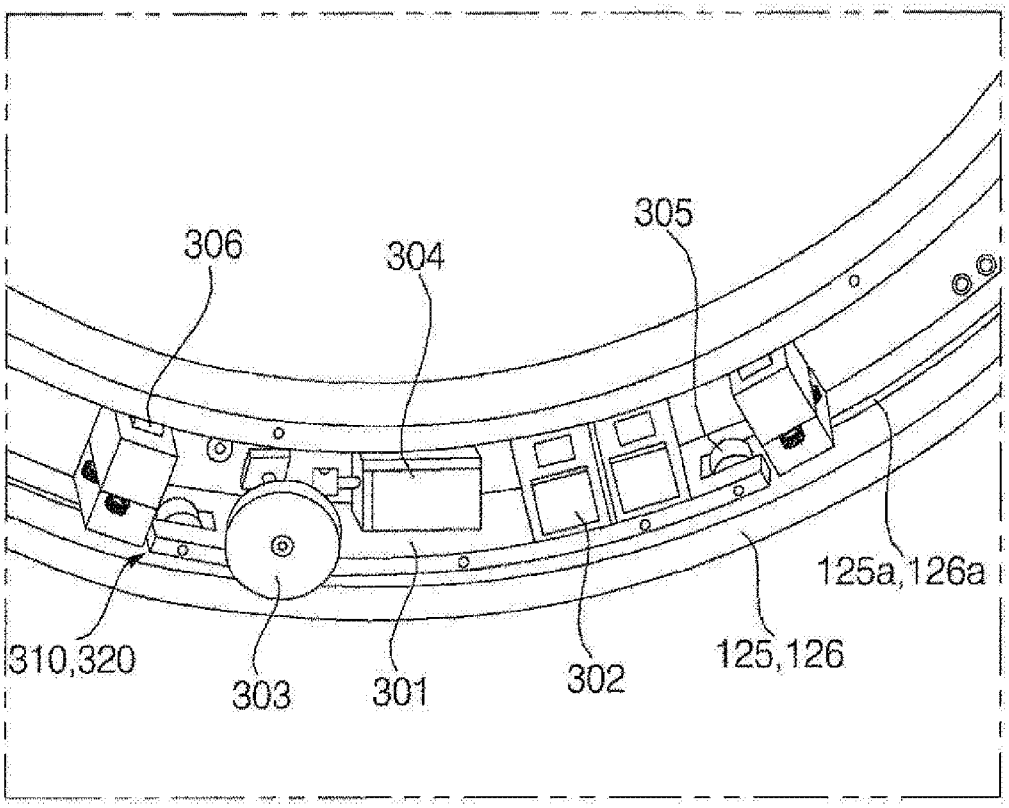
FIG. 4 is a perspective view of a balancing unit according to the embodiment of the present invention.

FIG. 4 is a perspective view of the balancing unit according to the embodiment of the present invention.

Each of the plurality of front balancing units 310 and the plurality of rear balancing units 320 includes a frame body 301, a body 302, a wheel 303, a motor 304, a contact terminal 305, and a brake 306.

The frame body 301 forms the frame of each of the plurality of front balancing units 310 and the plurality of rear balancing units 320, to which other components such as the wheel 303, the body 302, and the motor 304 are coupled. It is desirable that the frame body 301 be formed in an arc shape so as to match the shape of the front guide rail 125 or the rear guide rail 126.

The body 302 has a weight suitable to serve as a mass body. In some embodiments, the wheel 303 rolls along the front guide rail 125 or the rear guide rail 126 so that each of the plurality of front balancing units 310 and the plurality of rear balancing units 320 may move. The wheel 303 may be made of a material having a large frictional force so that the wheel 303 may not slip in the front guide rail 125 or the rear guide rail 126. The wheel 303 is rotated by the motor 304. In some embodiments, the wheel 303 may be replaced with a gear, such as a pinion gear or a worm gear. Further, when the wheel 303 is replaced with a gear, the front guide rail 125 or the rear guide rail 126 may include a rack gear or a worm wheel.

The motor 304 rotates the wheel 303. The motor 304 receives power from the contact terminal 305 to generate torque. The contact terminal 305 contacts the front guide rail wire 125*a* or the rear guide rail wire 126*a* to transmit power, supplied from an external source, to the motor 304. It is desirable that the contact terminal 305 be made of a metal material having a small frictional force, so that the contact terminal 305 remains in contact with the front guide rail wire 125*a* or the rear guide rail wire 126*a* without interruption of power.

The brake 306 allows each of the plurality of front balancing units 310 and the plurality of rear balancing units 320 to stop at a certain position of the guide rail 125. Since the front guide rail 125 or the rear guide rail 126 rotates together with the drum 124, the brake 306 is necessary in order to prevent free rotation of each of the plurality of front balancing units 310 and the plurality of rear balancing units 320. The brake 306 applies a frictional force to the front guide rail 125 or the rear guide rail 126 in order to fix the plurality of front balancing units 310 and the plurality of rear balancing units 320 to the front guide rail 125 or the rear guide rail 126, respectively.

Figure 5:
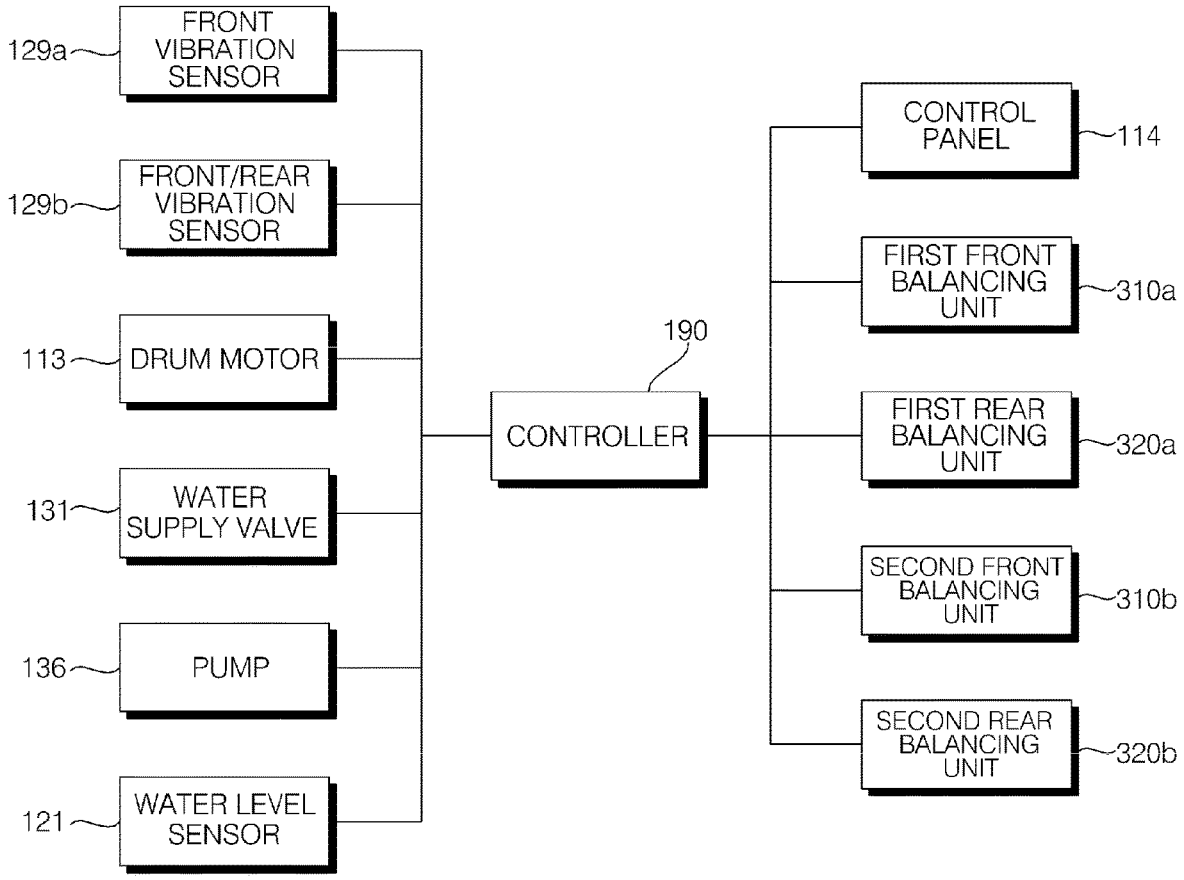
FIG. 5 is a block diagram of the washing machine according to the embodiment of the present invention.

FIG. 5 is a block diagram of the washing machine according to the embodiment of the present invention.

The controller 190 controls the overall operation of the washing machine 100 according to operation commands input to the control panel 114. The controller 190 may include a microcomputer, a storage device, and other electronic components, which control the operation of the washing machine 100. According to a wash course selected by a user, the controller 190 determines whether to perform each cycle, whether to perform processes of water supply, washing, rinsing, drainage, dehydration, drying, and the like in each cycle, the operation time of each process, and the number of iterations of each process, and controls the water supply valve 131, the drum motor 113, and the pump 136 based on the determination result. The controller 190 controls the water supply valve 131, the drum motor 113, and the pump 136 based on the amount of laundry, which is the weight of laundry measured at the initial stage of washing, and the water level in the tub 122, which is measured by the water level sensor 121.

The controller 190 controls the first front balancing unit 310*a*, the second front balancing unit 310*b*, the first rear balancing unit 320*a*, and the second rear balancing unit 320*b* based on the amount of vibration of the tub 122, which is measured by the front vibration sensor 129*a* and the rear vibration sensor 129*b*.

Figure 6:
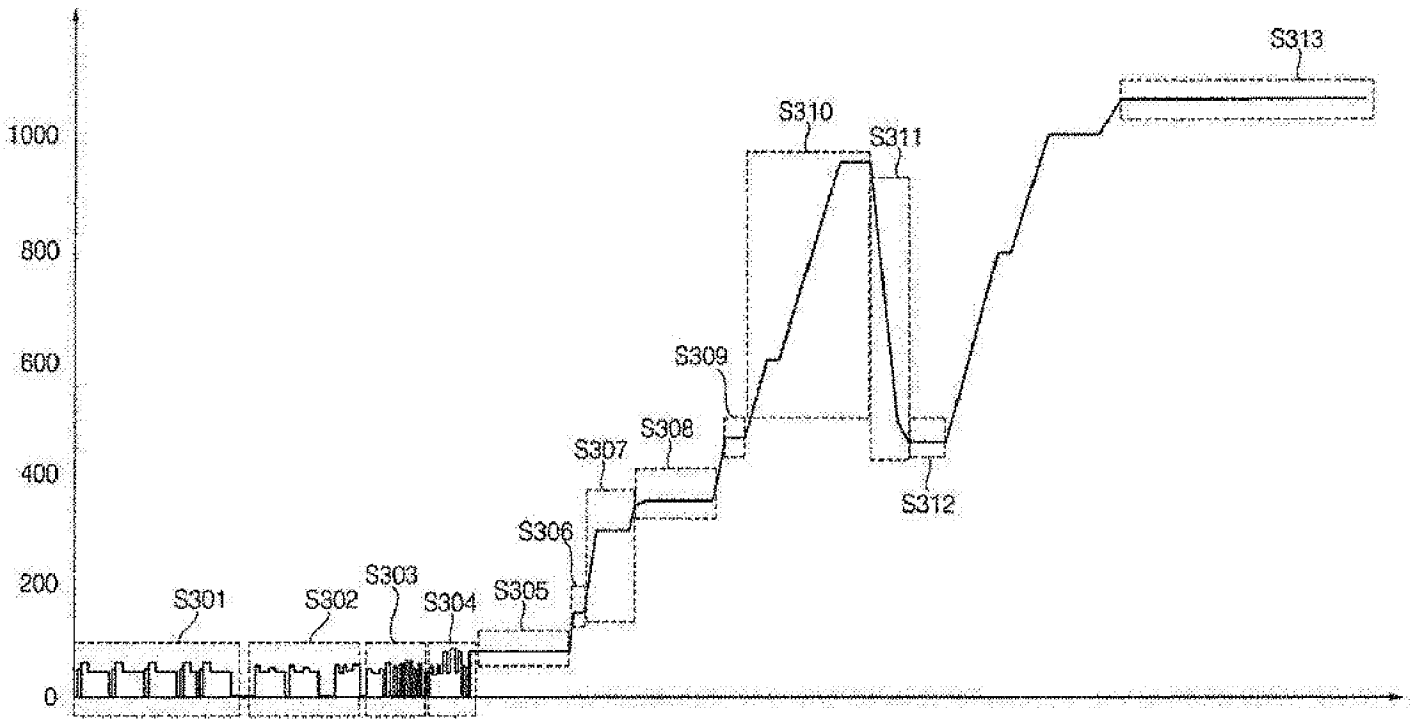
FIG. 6 is a diagram illustrating the rotation speed of the drum at the beginning of dehydration and in the course of dehydration in the washing machine according to the embodiment of the present invention.
Figure 7:
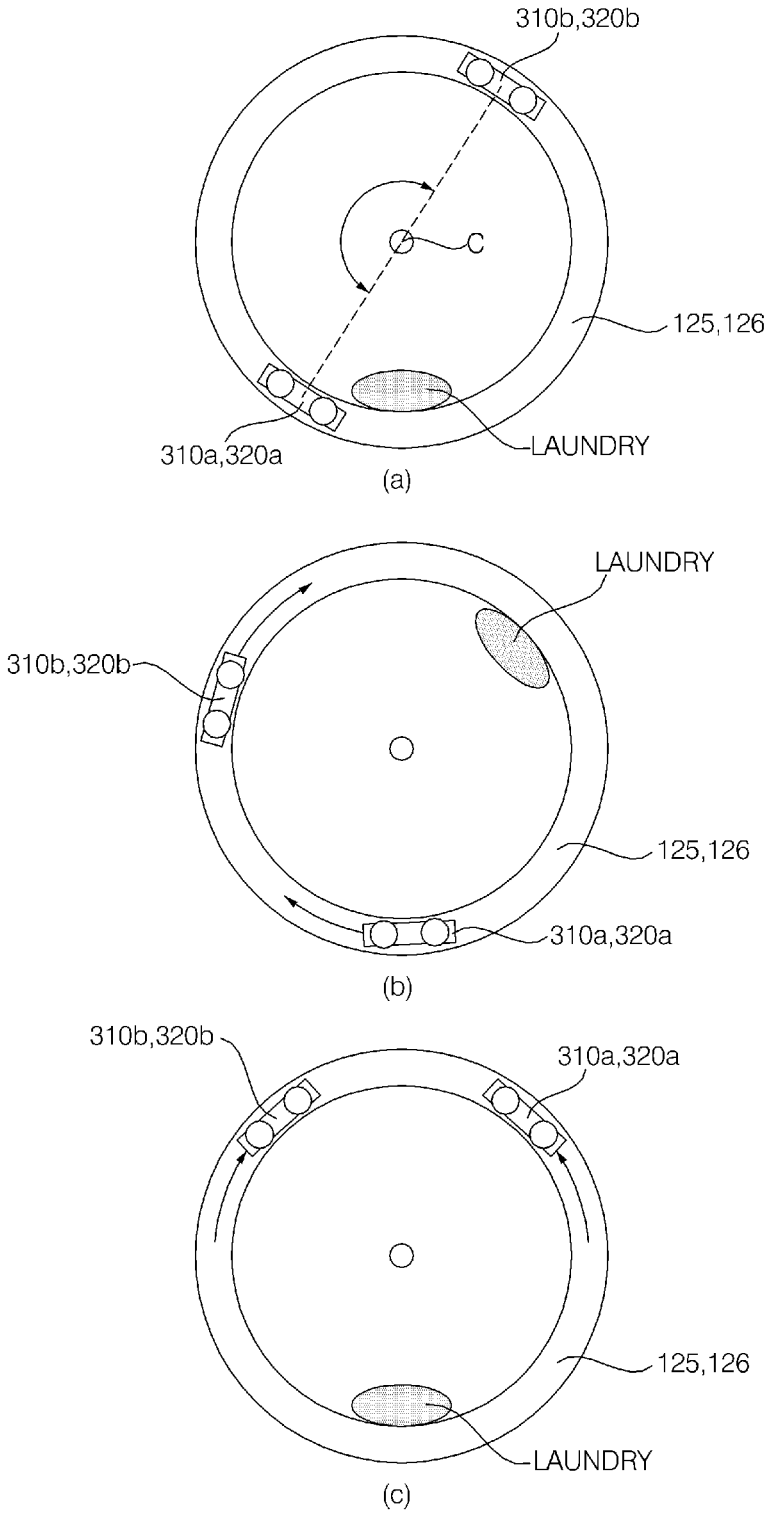
FIG. 7 is a diagram illustrating a process of controlling the balancing unit at the beginning of dehydration and in the course of dehydration in the washing machine according to the embodiment of the present invention.

FIG. 6 is a diagram illustrating the rotation speed of the drum at the beginning of dehydration and in the course of dehydration in the washing machine according to the embodiment of the present invention, and FIG. 7 is a diagram illustrating a process of controlling the balancing unit at the beginning of dehydration and in the course of dehydration in the washing machine according to the embodiment of the present invention.

<Rinsing>

The controller 190 performs rinsing by controlling the drum motor 113 to rotate the drum 124 in one direction so that after laundry is lifted, the laundry is separated from the inner circumferential surface of the drum 124 and falls (S301). The rinsing is a process of rotating the drum 124 at a rotation speed at which the centrifugal force is 1G or less in order to remove remaining detergent and contaminants from the laundry. The controller 190 controls the pump 136 to circulate wash water in the tub 122 and to spray the wash water into the drum 124 through the circulation nozzle 127. During the rinsing process, the controller 190 controls the drum motor 113 such that the drum 124 repeats the operation of rotating at 46 RPM for a predetermined period of time, stopping rotating, and then rotating again at 46 RPM.

<Balancing Unit Alignment>

In the final stage of rinsing, the controller 190 controls the movement of the first front balancing unit 310*a* and/or the second front balancing unit 310*b* such that the angle between the first front balancing unit 310*a* and the second front balancing unit 310*b* becomes 180 degrees with respect to the center of rotation of the drum 124, and controls the movement of the first rear balancing unit 320*a* and/or the second rear balancing unit 320*b* such that the angle between the first rear balancing unit 320*a* and the second rear balancing unit 320*b* becomes 180 degrees with respect to the center of rotation of the drum 124 (S302). In this case, the controller 190 continues the rinsing process by controlling the drum motor 113 such that the drum 124 repeats the operation of rotating at 46 RPM, which is the rotation speed at which the centrifugal force is 1G or less, for a predetermined period of time, stopping rotating, and then rotating again at 46 RPM.

Under the control of the controller 190, both the first front balancing unit 310*a* and the second front balancing unit 310*b* move along the front guide rail 125, or any one of them stops moving and the other one moves along the front guide rail 125, so that the angle therebetween becomes 180 degrees with respect to the center C of rotation of the drum 124, as illustrated in section (a) of FIG. 7.

Similarly, under the control of the controller 190, both the first rear balancing unit 320*a* and the second rear balancing unit 320*b* move along the rear guide rail 126, or any one of them stops moving and the other one moves along the rear guide rail 126, so that the angle therebetween becomes 180 degrees with respect to the center C of rotation of the drum 124, as illustrated in section (a) of FIG. 7.

The controller 190 causes the included angle between the first front balancing unit 310*a* and the second front balancing unit 310*b* to be 180 degrees, and causes the included angle between the first rear balancing unit 320*a* and the second rear balancing unit 320*b* to be 180 degrees, so that the imbalance caused by the plurality of front balancing units 310 and the plurality of rear balancing units 320 may be minimized during first rough balancing, which will be described later.

<Drainage>

The controller 190 operates the pump 136 to discharge the wash water in the tub 122 outside through the drain passage 138 (S303). The controller 190 controls the drum motor 113 during drainage to repeat acceleration and deceleration of the drum 124. When the water level in the tub 122, which is measured by the water level sensor 121, is lowered to a water level for dehydration, the controller 190 stops the operation of the pump 136 and stops the drainage.

<Laundry Distribution>

The controller 190 controls the drum motor 113 to repeat acceleration and deceleration of the drum 124, and senses the amount of vibration of the tub 122 through the front vibration sensor 129*a* and/or the rear vibration sensor 129*b* (S304). The controller 190 controls the drum motor 113 to repeat the operation of accelerating the drum 124 to 80 RPM, which is the rotation speed at which the laundry starts to cling to the inner circumferential surface of the drum 124, and then decelerating the drum 124, thereby distributing the laundry. The distribution of laundry is performed by accelerating the drum 124 to a rotation speed at which the centrifugal force is about 1G and then decelerating the drum 124, so that the laundry in the drum 124 is evenly distributed without being concentrated on one side.

The front vibration sensor 129*a* and/or the rear vibration sensor 129*b* measure the amount of vibration of the tub 122 when the drum 124 is repeatedly accelerated and decelerated. When the amount of vibration of the tub 122, which is measured by the front vibration sensor 129*a* and/or the rear vibration sensor 129*b*, exceeds a predetermined vibration amount for entry into a dehydration process, the controller 190 continues distribution of laundry by repeating acceleration and deceleration of the drum 124. When the amount of vibration of the tub 122, which is measured by the front vibration sensor 129*a* and/or the rear vibration sensor 129*b*, does not exceed a predetermined vibration amount for entry into a dehydration process, the controller 190 performs a subsequent process.

Generally, the laundry is concentrated on the rear side of the drum 124, and thus the amount of vibration generated at the rear side of the tub 122 is larger than the amount of vibration generated at the front side of the tub 122. In the embodiment, when the rear vibration amount of the tub 122 measured by the rear vibration sensor 129*b* does not exceed the vibration amount for entry into a dehydration process, the controller 190 performs a subsequent process.

<First Rough Balancing>

The controller 190 controls the drum motor 113 to rotate the drum 124 at 80 RPM, which is the rotation speed at which the laundry starts to cling to the inner circumferential surface of the drum 124, and controls the plurality of front balancing units 310 and the plurality of rear balancing units 320, thereby performing first rough balancing (S305). During the first rough balancing, it is desirable for the controller 190 to operate the pump 136 to discharge the wash water in the tub 122 outside through the drain passage 138. The controller 190 controls the drum motor 113 to rotate the drum 124 while maintaining the rotation speed at 80 RPM, at which the centrifugal force is about 1G. During the first rough balancing, in which the drum 124 rotates at 80 RPM, the controller 190 controls the plurality of front balancing units 310 and the plurality of rear balancing units 320 to perform direct balancing.

The direct balancing is performed such that the plurality of front balancing units 310 is moved so that the front vibration amount of the tub 122, which is measured by the front vibration sensor 129*a*, does not exceed a predetermined front vibration amount of the first rough balancing and such that the plurality of rear balancing units 320 is moved so that the rear vibration amount of the tub 122, which is measured by the rear vibration sensor 129*b*, does not exceed a predetermined rear vibration amount of the first rough balancing. In this case, the rear vibration amount of the first rough balancing is greater than the front vibration amount of the first rough balancing.

Hereinafter, the direct balancing will be described with reference to sections (b) and (c) of FIG. 7 using the plurality of front balancing units 310 as an example.

As illustrated in section (b) of FIG. 7, the controller 190 moves the first front balancing unit 310*a* and the second front balancing unit 310*b* in the same rotation direction. The controller 190 moves the first front balancing unit 310*a* and the second front balancing unit 310*b* in the same rotation direction until the front vibration amount of the tub 122, which is measured by the front vibration sensor 129*a*, is reduced. When the front vibration amount of the tub 122, which is measured by the front vibration sensor 129*a*, is increased, the controller 190 moves the first front balancing unit 310*a* and the second front balancing unit 310*b* in the reverse rotation direction. The controller 190 stops the movement of the first front balancing unit 310*a* and the second front balancing unit 310*b* at the point at which the front vibration amount of the tub 122, which is measured by the front vibration sensor 129*a*, is minimized.

The controller 190 moves the first front balancing unit 310*a* and the second front balancing unit 310*b* in the same rotation direction to minimize the front vibration amount of the tub 122, measured by the front vibration sensor 129*a*, and thereafter moves the first front balancing unit 310*a* and the second front balancing unit 310*b* in different rotation directions from each other, as illustrated in section (c) of FIG. 7. The controller 190 moves the first front balancing unit 310*a* and the second front balancing unit 310*b* in the direction in which the angle between the first front balancing unit 310*a* and the second front balancing unit 310*b* with respect to the center C of rotation of the drum 124 is reduced until the front vibration amount of the tub 122, which is measured by the front vibration sensor 129*a*, is reduced. When the front vibration amount of the tub 122, which is measured by the front vibration sensor 129*a*, is increased, the controller 190 moves the first front balancing unit 310*a* and the second front balancing unit 310*b* in the direction in which the included angle between the first front balancing unit 310*a* and the second front balancing unit 310*b* is increased. The controller 190 stops the movement of the first front balancing unit 310*a* and the second front balancing unit 310*b* at the point at which the front vibration amount of the tub 122, which is measured by the front vibration sensor 129*a*, is minimized.

The controller 190 repeats the operation of moving the first front balancing unit 310*a* and the second front balancing unit 310*b* in different rotation directions from each other to minimize the front vibration amount of the tub 122, measured by the front vibration sensor 129*a*, and thereafter moving the first front balancing unit 310*a* and the second front balancing unit 310*b* in the same rotation direction again to minimize the front vibration amount of the tub 122, measured by the front vibration sensor 129*a*.

The controller 190 repeats the operation of moving the plurality of front balancing units 310 in the same rotation direction and then in different rotation directions until the front vibration amount of the tub 122, which is measured by the front vibration sensor 129*a*, becomes equal to or smaller than the predetermined front vibration amount of the first rough balancing.

During the direct balancing, the controller 190 performs the above-described process for the first rear balancing unit 320*a* and the second rear balancing unit 320*b*. That is, the controller 190 repeats the operation of moving the plurality of rear balancing units 320 in the same rotation direction and then in different rotation directions until the rear vibration amount of the tub 122, which is measured by the rear vibration sensor 129*b*, becomes equal to or smaller than the predetermined rear vibration amount of the first rough balancing.

During the direct balancing, it is desirable for the controller 190 to first perform direct balancing for the plurality of rear balancing units 320 and then to perform direct balancing for the plurality of front balancing units 310. As described above, since the rear vibration amount of the tub 122 is greater than the front vibration amount of the tub 122, the controller 190 first performs direct balancing for the plurality of rear balancing units 320, and then performs direct balancing for the plurality of front balancing units 310.

When the direct balancing is performed for the plurality of front balancing units 310 after the direct balancing for the plurality of rear balancing units 320 is completed, the rear vibration amount of the tub 122 may be increased due to the movement of the plurality of front balancing units 310. Therefore, it is desirable for the controller 190 to repeatedly perform direct balancing for the plurality of rear balancing units 320 and direct balancing for the plurality of front balancing units 310.

Upon completing the direct balancing for any balancing units, i.e. either the plurality of front balancing units 310 or the plurality of rear balancing units 320, when the front vibration amount of the tub 122, which is measured by the front vibration sensor 129*a*, is greater than the front vibration amount of the first rough balancing or when the rear vibration amount of the tub 122, which is measured by the rear vibration sensor 129*b*, is greater than the rear vibration amount of the first rough balancing, the controller 190 performs direct balancing for the other balancing units. That is, upon completing the direct balancing for any balancing units, i.e. either the plurality of front balancing units 310 or the plurality of rear balancing units 320, when the front vibration amount of the tub 122, which is measured by the front vibration sensor 129*a*, is equal to or smaller than the predetermined front vibration amount of the first rough balancing and when the rear vibration amount of the tub 122, which is measured by the rear vibration sensor 129*b*, is equal to or smaller than the predetermined rear vibration amount of the first rough balancing, the controller 190 stops repeating the direct balancing for the plurality of rear balancing units 320 and the direct balancing for the plurality of front balancing units 310.

The controller 190 repeatedly performs direct balancing for the plurality of rear balancing units 320 and direct balancing for the plurality of front balancing units 310. However, when the direct balancing is repeated three times or more, the controller 190 controls the drum motor 113 to stop the drum 124, and performs the above-described distribution of laundry.

When the vibration amount of the tub 122, which is measured by the rear vibration sensor 129*b*, does not exceed the predetermined rear vibration amount of the first rough balancing and when the front vibration amount of the tub 122, which is measured by the front vibration sensor 129*a*, does not exceed the predetermined front vibration amount of the first rough balancing, the controller 190 accelerates the drum 124 to perform a subsequent process.

<Second Rough Balancing>

The controller 190 controls the drum motor 113 to rotate the drum 124 at 150 RPM, which is the rotation speed at which the laundry clings to the inner circumferential surface of the drum 124, and controls the plurality of front balancing units 310 and the plurality of rear balancing units 320, thereby performing second rough balancing (S306). During the second rough balancing, it is desirable for the controller 190 to operate the pump 136 to discharge the wash water in the tub 122 outside through the drain passage 138. The controller 190 controls the drum motor 113 to rotate the drum 124 while maintaining the rotation speed at 150 RPM, at which the centrifugal force exceeds 1G. During the second rough balancing, in which the drum 124 rotates at 150 RPM, the controller 190 controls the plurality of front balancing units 310 and the plurality of rear balancing units 320 to perform the above-described direct balancing.

During the second rough balancing, the controller 190 moves the plurality of front balancing units 310 so that the front vibration amount of the tub 122, which is measured by the front vibration sensor 129*a*, does not exceed a predetermined front vibration amount of the second rough balancing, and moves the plurality of rear balancing units 320 so that the rear vibration amount of the tub 122, which is measured by the rear vibration sensor 129*b*, does not exceed a predetermined rear vibration amount of the second rough balancing. In this case, the rear vibration amount of the second rough balancing is greater than the front vibration amount of the second rough balancing. Further, the front vibration amount of the second rough balancing is greater than the above-described front vibration amount of the first rough balancing, and the rear vibration amount of the second rough balancing is greater than the above-described rear vibration amount of the first rough balancing.

During the second rough balancing, the controller 190 performs the same control as the direct balancing performed during the above-described first rough balancing.

That is, the controller 190 repeats the operation of moving the plurality of front balancing units 310 in the same rotation direction and then in different rotation directions until the front vibration amount of the tub 122, which is measured by the front vibration sensor 129*a*, becomes equal to or smaller than the predetermined front vibration amount of the second rough balancing. In addition, the controller 190 repeats the operation of moving the plurality of rear balancing units 320 in the same rotation direction and then in different rotation directions until the rear vibration amount of the tub 122, which is measured by the rear vibration sensor 129*b*, becomes equal to or smaller than the predetermined rear vibration amount of the second rough balancing. In addition, the controller 190 repeatedly performs direct balancing for the plurality of rear balancing units 320 and direct balancing for the plurality of front balancing units 310.

When the vibration amount of the tub 122, which is measured by the rear vibration sensor 129*b*, does not exceed the predetermined rear vibration amount of the second rough balancing and when the front vibration amount of the tub 122, which is measured by the front vibration sensor 129*a*, does not exceed the predetermined front vibration amount of the second rough balancing, the controller 190 controls the drum motor 113 to perform a subsequent process.

<Excessive Balancing>

The controller 190 controls the drum motor 113 to accelerate the drum 124 to 350 RPM, and measures the front vibration amount and the rear vibration amount of the tub 122 through the front vibration sensor 129*a* and the rear vibration sensor 129*b*. When the front vibration amount of the tub 122, which is measured by the front vibration sensor 129*a*, exceeds a predetermined front excessive vibration amount or when the rear vibration amount of the tub 122, which is measured by the rear vibration sensor 129*b*, exceeds a predetermined rear excessive vibration amount, the controller 190 controls the drum motor 113 to maintain the rotation speed of the drum 124, thereby performing excessive balancing (S307).

While the drum 124 is accelerated from 150 RPM to 350 RPM, a large amount of vibration may be generated in the washing machine 100 due to resonance with the floor. Such resonance temporarily occurs when a natural frequency of the floor is equal to or a multiple of a vibration frequency of the washing machine 100. Accordingly, if vibration is not severe, the drum 124 is accelerated to 350 RPM. Excessive balancing is performed only when severe vibration is generated.

Thus, if the front vibration amount of the tub 122, which is measured by the front vibration sensor 129*a*, does not exceed the front excessive vibration amount and the rear vibration amount of the tub 122, which is measured by the rear vibration sensor 129*b*, does not exceed the rear excessive vibration amount, the controller 190 accelerates the drum 124 to 350 RPM, and otherwise, the controller 190 performs excessive balancing. In this case, the front excessive vibration amount is greater than the rear excessive vibration amount. Further, the front excessive vibration amount is greater than the front vibration amount of the second rough balancing, and the rear excessive vibration amount is greater than the rear vibration amount of the second rough balancing.

The excessive balancing is performed such that, while the drum 124 is accelerated, if the front vibration amount of the tub 122 exceeds the front excessive vibration amount or if the rear vibration amount of the tub 122 exceeds the rear excessive vibration amount, the drum motor 113 is controlled to maintain the rotation speed of the drum 124, and the above-described direct balancing is performed for the plurality of front balancing units 310 and the plurality of rear balancing units 320.

During the excessive balancing, the controller 190 moves the plurality of front balancing units 310 so that the front vibration amount of the tub 122, which is measured by the front vibration sensor 129*a*, does not exceed a predetermined front vibration amount of excessive balancing, and moves the plurality of rear balancing units 320 so that the rear vibration amount of the tub 122, which is measured by the rear vibration sensor 129*b*, does not exceed a predetermined rear vibration amount of excessive balancing. In this case, the rear vibration amount of excessive balancing is greater than the front vibration amount of excessive balancing. Further, the front vibration amount of excessive balancing is smaller than the above-described front excessive vibration amount, but is equal to or greater than the above-described front vibration amount of the second rough balancing. The rear vibration amount of excessive balancing is smaller than the above-described rear excessive vibration amount, but is equal to or greater than the above-described rear vibration amount of the second rough balancing.

During the excessive balancing, the controller 190 performs the same control as the direct balancing performed during the first and second rough balancing described above.

That is, the controller 190 repeats the operation of moving the plurality of front balancing units 310 in the same rotation direction and then in different rotation directions until the front vibration amount of the tub 122, which is measured by the front vibration sensor 129*a*, becomes equal to or smaller than the predetermined front vibration amount of the excessive balancing. In addition, the controller 190 repeats the operation of moving the plurality of rear balancing units 320 in the same rotation direction and then in different rotation directions until the rear vibration amount of the tub 122, which is measured by the rear vibration sensor 129*b*, becomes equal to or smaller than the predetermined rear vibration amount of the excessive balancing. In addition, the controller 190 repeatedly performs direct balancing for the plurality of rear balancing units 320 and direct balancing for the plurality of front balancing units 310.

When the rotation speed of the drum 124 reaches 350 RPM, the controller 190 performs a subsequent process.

<Third Rough Balancing>

The controller 190 controls the drum motor 113 to rotate the drum 124 at 350 RPM and controls the plurality of front balancing units 310 and the plurality of rear balancing units 320, thereby performing third rough balancing (S307). During the third rough balancing, it is desirable for the controller 190 to operate the pump 136 to discharge the wash water in the tub 122 outside through the drain passage 138. During the third rough balancing, in which the drum 124 rotates at 350 RPM, the controller 190 controls the plurality of front balancing units 310 and the plurality of rear balancing units 320 to perform the above-described direct balancing.

During the third rough balancing, the controller 190 moves the plurality of front balancing units 310 so that the front vibration amount of the tub 122, which is measured by the front vibration sensor 129*a*, does not exceed a predetermined front vibration amount of the third rough balancing, and moves the plurality of rear balancing units 320 so that the rear vibration amount of the tub 122, which is measured by the rear vibration sensor 129*b*, does not exceed a predetermined rear vibration amount of the third rough balancing. If the rotation speed of the drum 124 exceeds 350 RPM, a large amount of vibration may be suddenly generated even by a small degree of imbalance. Therefore, the front vibration amount of the third rough balancing is smaller than the above-described front vibration amount of the first rough balancing, and the rear vibration amount of the third rough balancing is smaller than the above-described rear vibration amount of the first rough balancing. Further, the rear vibration amount of the third rough balancing is equal to or greater than the front vibration amount of the third rough balancing.

During the third rough balancing, the controller 190 performs the same control as the direct balancing performed during the first and second rough balancing described above.

That is, the controller 190 repeats the operation of moving the plurality of front balancing units 310 in the same rotation direction and then in different rotation directions until the front vibration amount of the tub 122, which is measured by the front vibration sensor 129*a*, becomes equal to or smaller than the predetermined front vibration amount of the third rough balancing. In addition, the controller 190 repeats the operation of moving the plurality of rear balancing units 320 in the same rotation direction and then in different rotation directions until the rear vibration amount of the tub 122, which is measured by the rear vibration sensor 129*b*, becomes equal to or smaller than the predetermined rear vibration amount of the third rough balancing. In addition, the controller 190 repeatedly performs direct balancing for the plurality of rear balancing units 320 and direct balancing for the plurality of front balancing units 310.

When the vibration amount of the tub 122, which is measured by the rear vibration sensor 129*b*, does not exceed the predetermined rear vibration amount of the third rough balancing and when the front vibration amount of the tub 122, which is measured by the front vibration sensor 129*a*, does not exceed the predetermined front vibration amount of the third rough balancing, the controller 190 accelerates the drum 124 to perform a subsequent process.

<First Fine Balancing>

The controller 190 controls the drum motor 113 to rotate the drum 124 at 460 RPM and controls the plurality of front balancing units 310 and the plurality of rear balancing units 320, thereby performing first fine balancing (S307). During the first fine balancing, it is desirable for the controller 190 to operate the pump 136 to discharge the wash water in the tub 122 outside through the drain passage 138. During the first fine balancing, in which the drum 124 rotates at 460 RPM, the controller 190 controls the plurality of front balancing units 310 and the plurality of rear balancing units 320 to perform the above-described direct balancing and correction balancing.

When the drum 124 rotates at the rotation speed of 600 RPM or higher, wash water contained in laundry is significantly reduced, and the center of gravity of the drum 124 is changed, thereby causing imbalance. However, when the rotation speed of the drum 124 exceeds 460 RPM, balancing may not be performed since the plurality of front balancing units 310 and the plurality of rear balancing units 320 may not move actively using the motor 304. Therefore, when the drum 124 rotates at 600 RPM or higher (a "dehydration" process to be described later), correction balancing is performed at 460 RPM, during which balancing is performed by estimating variation in imbalance caused by reduction in the water content of the laundry.

During the direct balancing in the first fine balancing, the controller 190 moves the plurality of front balancing units 310 so that the front vibration amount of the tub 122, which is measured by the front vibration sensor 129*a*, does not exceed a predetermined front vibration amount of the fine balancing, and moves the plurality of rear balancing units 320 so that the rear vibration amount of the tub 122, which is measured by the rear vibration sensor 129*b*, does not exceed a predetermined rear vibration amount of the fine balancing. If the rotation speed of the drum 124 exceeds 350 RPM, a large amount of vibration may be suddenly generated even by a small degree of imbalance. Therefore, the front vibration amount of the fine balancing is smaller than the above-described front vibration amount of the third rough balancing, and the rear vibration amount of the fine balancing is smaller than the above-described rear vibration amount of the third rough balancing. Further, the rear vibration amount of the fine balancing is equal to or greater than the front vibration amount of the fine balancing.

During the direct balancing in the first fine balancing, the controller 190 performs the same control as the direct balancing performed during the above-described rough balancing.

That is, the controller 190 repeats the operation of moving the plurality of front balancing units 310 in the same rotation direction and then in different rotation directions until the front vibration amount of the tub 122, which is measured by the front vibration sensor 129*a*, becomes equal to or smaller than the predetermined front vibration amount of the fine balancing. In addition, the controller 190 repeats the operation of moving the plurality of rear balancing units 320 in the same rotation direction and then in different rotation directions until the rear vibration amount of the tub 122, which is measured by the rear vibration sensor 129*b*, becomes equal to or smaller than the predetermined rear vibration amount of the fine balancing. In addition, the controller 190 repeatedly performs direct balancing for the plurality of rear balancing units 320 and direct balancing for the plurality of front balancing units 310.

When the vibration amount of the tub 122, which is measured by the rear vibration sensor 129*b*, does not exceed the predetermined rear vibration amount of the fine balancing and when the front vibration amount of the tub 122, which is measured by the front vibration sensor 129*a*, does not exceed the predetermined front vibration amount of the fine balancing, the controller 190 performs correction balancing.

The correction balancing is performed such that the plurality of front balancing units 310 and the plurality of rear balancing units 320 are moved by estimating variation in imbalance caused by reduction in the water content of the laundry when the drum 124 rotates at 600 RPM or higher. During the correction balancing, the controller 190 moves the plurality of front balancing units 310 and the plurality of rear balancing units 320 by applying a change of water content preset according to the types of laundry. The controller 190 may determine the types of laundry according to wash courses set by a user for the types of laundry. Further, the controller 190 may determine the types of laundry based on an amount of laundry, which is the weight of laundry measured at the initial stage of washing, and based on the front vibration amount and the rear vibration amount of the tub 122, which are measured during the first to third balancing.

The controller calculates, through experiment, the change of imbalance caused by the change of water content according to the types of laundry. Based on the calculated change of imbalance, the controller calculates a first front variation value, which is a variation value of the included angle between the plurality of front balancing units 310, and a first rear variation value, which is a variation value of the included angle of the plurality of rear balancing units 320, and stores the calculated values. The controller 190 controls the plurality of front balancing units 310 to move in different rotation directions, thereby changing the included angle between the first front balancing unit 310*a* and the second front balancing unit 310*b* by a predetermined first front variation value. Further, the controller 190 controls the plurality of rear balancing units 320 to move in different rotation directions, thereby changing the included angle between the first rear balancing unit 320*a* and the second rear balancing unit 320*b* by a predetermined first rear variation value.

Generally, since the water content of laundry is reduced when the drum 124 rotates at 600 RPM or higher, the first front variation value and the first rear variation value are set so that the included angle increases. Therefore, during the correction balancing in the first fine balancing, the controller 190 increases the included angle of the plurality of front balancing units 310 by the first front variation value, and increases the included angle of the plurality of rear balancing units 320 by the first rear variation value.

Upon completing the correction balancing in the first fine balancing, the controller 190 controls the drum motor 304 to perform a subsequent process.

Depending on the types of laundry and washing courses, the correction balancing described above in the first fine balancing may be omitted.

<First Dehydration>

The controller 190 controls the drum motor 113 to accelerate the drum 124 to 950 RPM to remove moisture contained in the laundry, and measures the front vibration amount and the rear vibration amount of the tub 122 through the front vibration sensor 129*a* and the rear vibration sensor 129*b*, thereby performing first dehydration (S310). During the first dehydration, the controller intermittently operates the pump 136 to discharge the wash water in the tub 122 outside through the drain passage 138.

The front vibration amount and the rear vibration amount of the tub 122, which are measured during the first dehydration, are used for correction balancing in second fine balancing, which will be described later.

When the rotation speed of the drum 124 reaches 950 RPM, the controller 190 maintains the rotation speed of the drum 124 for several seconds, and then performs a subsequent process.

<High-Speed Sensing of Amount of Laundry>

The controller 190 controls the drum motor 113 to stop the drum 124, and senses the amount of laundry, which is the weight of the laundry (S311). Upon controlling the drum motor 113 to stop the drum 124, the controller 190 senses the amount of the laundry by measuring a time taken for the drum 124 to decelerate to a predetermined rotation speed (500 RPM in the embodiment). When the deceleration time gets longer, the controller determines that the weight of the laundry is relatively heavy, indicating a high level of the laundry amount. The controller 190 stores the relationship between the deceleration time and the laundry amount, which is obtained through experiment, and calculates the amount of the laundry based on the relationship. Based on the sensed amount of the laundry, the controller 190 performs correction balancing in a second fine balancing and second dehydration, which will be described later.

Upon sensing the amount of the laundry, the controller 190 controls the drum motor 113 to rotate the drum 124 at 460 RPM and performs a subsequent process.

<Second Fine Balancing>

The controller 190 controls the drum motor 113 to rotate the drum 124 at 460 RPM, and controls the plurality of front balancing units 310 and the plurality of rear balancing units 320, thereby performing second fine balancing (S312). During the second fine balancing, in which the drum 124 rotates at 460 RPM, the controller 190 performs the above-described direct balancing and the above-described correction balancing by controlling the plurality of front balancing units 310 and the plurality of rear balancing units 320.

The direct balancing in the second fine balancing is completely the same as the direct balancing in the first fine balancing, and thus a description thereof will be omitted.

The purpose of the correction balancing in the second fine balancing is the same as the purpose of the correction balancing in the first fine balancing. However, during the correction balancing in the second fine balancing, a second front variation value, which is a variation value of the included angle between the plurality of front balancing units 310, and a second rear variation value, which is a variation value of the included angle between the plurality of rear balancing units 320, are set based on the front vibration amount and the rear vibration amount of the tub 122, which are measured during the first dehydration, and based on the amount of laundry, which is measured while the amount of laundry is sensed at a high speed. During second dehydration to be described later, since the drum 124 rotates at a very high speed, a large amount of vibration may be generated even by a small change of imbalance, requiring more precise correction balancing.

Based on the change of water content according to the types of laundry as well as the front vibration amount and the rear vibration amount of the tub 122, which are measured during the first dehydration, and the amount of laundry, which is measured while the amount of laundry is sensed at a high speed, the controller calculates the second front variation value and the second rear variation value and stores the calculated values. The controller 190 moves the plurality of front balancing units 310 in different rotation directions in order to change the included angle between the first front balancing unit 310*a* and the second front balancing unit 310*b* by a predetermined second front variation value. Further, the controller 190 moves the plurality of rear balancing units 320 in different rotation directions in order to change the included angle between the first rear balancing unit 320*a* and the second rear balancing unit 320*b* by a predetermined second rear variation value.

Since the second front variation value and the second rear variation value are set in consideration of the water content of the laundry as well as the front vibration amount and the rear vibration amount of the tub 122, which are measured during the first dehydration, and the amount of laundry, which is measured while the amount of laundry is sensed at a high speed, the included angles are set so as to increase or decrease.

Thus, during the correction balancing in the first fine balancing, the controller 190 increases or decreases the included angle of the plurality of front balancing units 310 by the first front variation value, and increases or decreases the included angle of the plurality of rear balancing units 320 by the first rear variation value.

Upon completing the correction balancing in the second fine balancing, the controller 190 controls the drum motor 304 to perform a subsequent process.

Depending on the types of laundry, the wash courses, the amount of laundry, which is measured while the amount of laundry is sensed at a high speed, and the front vibration amount and the rear vibration amount of the tub 122, which are measured during the first dehydration, the above-described correction balancing in the second fine balancing may be omitted.

<Second Dehydration>

The controller 190 controls the drum motor 113 to accelerate the drum 124 to the maximum rotation speed to remove moisture contained in the laundry, thereby performing second dehydration (S313). When the rotation speed of the drum 124 exceeds 1000 RPM, resonance occurs between the washing machine 100 and the floor. Therefore, the controller 190 sets the maximum rotation speed according to the amount of laundry, which is measured while the amount of laundry is sensed at a high speed. In the embodiment, when the amount of laundry, which is measured while the amount of laundry is sensed at a high speed, is lower than a predetermined reference high-speed laundry amount, the controller 190 sets the maximum rotation speed to be 1060 RPM, and when the amount of laundry, which is measured while the amount of laundry is sensed at a high speed, is greater than the predetermined reference high-speed laundry amount, the controller 190 sets the maximum rotation speed to be 1010 RPM. During the second dehydration, the controller intermittently operates the pump 136 to discharge the wash water in the tub 122 outside through the drain passage 138.

After rotating the drum 124 at the maximum rotation speed for a predetermined period of time, the controller 190 controls the drum motor 113 to stop the drum 124, and terminates the dehydration.

It will be apparent that, although the preferred embodiments have been shown and described above, the present invention is not limited to the above-described specific embodiments, and various modifications and variations can be made by those skilled in the art without departing from the gist of the appended claims. Thus, it is intended that the modifications and variations should not be understood independently of the technical spirit or prospect of the present invention.

The invention claimed is:

1. A washing machine comprising:

a tub in which wash water is received;

a drum that is disposed inside the tub, that is configured to receive laundry therein, that has a cylindrical shape, and that is rotatable;

a plurality of balancing units that are configured to, based on rotation of the drum, move along a circumference of a front side or a rear side of the drum in order to reduce imbalance caused by concentration of the laundry;

a vibration sensor configured to measure a vibration amount of the tub; and a controller that is configured to move the plurality of balancing units according to the vibration amount of the tub and control rotation of the drum, wherein each of the plurality of balancing units is configured to move in a same rotation direction and then in different rotation directions, wherein each of the plurality of balancing units is configured to, based on rotation of the drum at a first rough rotation speed at which the laundry starts to cling to an inner circumferential surface of the drum, move in the same rotation direction and then in the different directions so that a first vibration amount of the tub measured by the vibration sensor does not exceed a predetermined first rough balancing vibration amount, and wherein each of the plurality of balancing units is configured to, based on rotation of the drum at a second rough rotation speed higher than the first rough rotation speed, move in the same rotation direction and then in the different directions so that a second vibration amount of the tub measured by the vibration sensor does not exceed a predetermined second rough balancing vibration amount.

2. The washing machine of claim 1, wherein the plurality of balancing units comprises a plurality of front balancing units moving along a circumference of a front side of the drum and a plurality of rear balancing units moving along a circumference of a rear side of the drum, wherein the vibration sensor comprises a front vibration sensor configured to measure a front vibration amount of the tub and a rear vibration sensor configured to measure a rear vibration amount of the tub, and wherein each of the plurality of rear balancing units is configured to, until the rear vibration amount of the tub, measured by the rear vibration sensor, becomes equal to or smaller than a predetermined rear balancing vibration amount, move in the same rotation direction and then in the different directions, and each of the plurality of front balancing units is configured to, until the front vibration amount of the tub, measured by the front vibration sensor, becomes equal to or smaller than a predetermined front balancing vibration amount, move in the same rotation direction and then in the different directions.

3. The washing machine of claim 2, wherein the rear balancing vibration amount is equal to or greater than the front balancing vibration amount.

4. The washing machine of claim 1, wherein the second rough balancing vibration amount is greater than the first rough balancing vibration amount.

5. The washing machine of claim 1, wherein, based on rotation of the drum at a third rough rotation speed, which is higher than the second rough rotation speed, each of the plurality of balancing units is configured to move in the same rotation direction and then in the different directions so that the vibration amount of the tub, measured by the vibration sensor, does not exceed a predetermined third rough balancing vibration amount.

6. The washing machine of claim 5, wherein the third rough balancing vibration amount is smaller than the first rough balancing vibration amount.

7. The washing machine of claim 1, wherein, based on a drum motor accelerating the drum and the vibration amount of the tub exceeding a predetermined excessive vibration amount, the drum motor is configured to maintain a rotation speed of the drum and each of the plurality of balancing units is configured to, until the vibration amount of the tub, measured by the vibration sensor, becomes equal to or smaller than a predetermined excessive balancing vibration amount, move in the same rotation direction and then in the different directions.

8. The washing machine of claim 7, wherein the excessive balancing vibration amount is equal to or greater than the second rough balancing vibration amount, and wherein the excessive vibration amount is greater than the excessive balancing vibration amount.

9. The washing machine of claim 1, wherein, based on rotation of the drum at a fine rotation speed, which is a maximum rotation speed at which the plurality of balancing units are movable each of the plurality of balancing units is configured to move in the same rotation direction and then in the different directions so that the vibration amount of the tub, measured by the vibration sensor, does not exceed a predetermined fine balancing vibration amount, and wherein an included angle of the plurality of balancing units is changed by a predetermined variation value.

* * * * *